US008936503B2

(12) United States Patent
Catanzaro et al.

(10) Patent No.: US 8,936,503 B2
(45) Date of Patent: Jan. 20, 2015

(54) MOBILE CELEBRATION DEVICE

(76) Inventors: David Joseph Catanzaro, Carbondale, PA (US); James Frances Loven, Scranton, PA (US)

( * ) Notice: Subject to any disclaimer, the term of this patent is extended or adjusted under 35 U.S.C. 154(b) by 50 days.

(21) Appl. No.: 13/350,724

(22) Filed: Jan. 13, 2012

(65) Prior Publication Data

US 2013/0183884 A1 Jul. 18, 2013

(51) Int. Cl.
*A63H 1/24* (2006.01)

(52) U.S. Cl.
USPC ..... 446/485; 446/242

(58) Field of Classification Search
USPC ..... 446/485
See application file for complete search history.

(56) References Cited

U.S. PATENT DOCUMENTS

| | | | | |
|---|---|---|---|---|
| 3,795,064 | A * | 3/1974 | Sims-Williams | 434/185 |
| 5,445,552 | A * | 8/1995 | Hine | 446/477 |
| 6,241,359 | B1 * | 6/2001 | Lin | 362/96 |
| 6,260,989 | B1 * | 7/2001 | Ingraselino | 362/383 |
| 6,589,094 | B2 * | 7/2003 | Spencer | 446/242 |
| 7,407,302 | B2 * | 8/2008 | Allard et al. | 362/109 |
| 7,757,624 | B2 * | 7/2010 | Landolt | 116/238 |
| 2005/0138851 | A1 * | 6/2005 | Ingraselino | 40/442 |
| 2010/0048097 | A1 * | 2/2010 | Ma | 446/473 |

* cited by examiner

*Primary Examiner* — Michael Dennis
(74) *Attorney, Agent, or Firm* — Jeffrey M. Furr, Esq.; Furr Law Firm

(57) ABSTRACT

The present is a mobile celebration device consisting of a movable object capable of descending down a straight article (or simulating the descend) and including a transportable base apparatus securing the straight article in a vertical position. The mobile celebration device is incorporated with the transportable base apparatus in a vertical position allowing the movable object to descend and to reset thereon. The transportable base apparatus can take the form of eyeglasses, a hat, a tiara, a handle and finger ring or clip.

13 Claims, 14 Drawing Sheets

MOBILE CELEBRATION DEVICE

CROSS-REFERENCES TO RELATED APPLICATIONS (IF ANY)

None.

STATEMENT AS TO RIGHTS TO INVENTIONS MADE UNDER FEDERALLY-SPONSORED RESEARCH AND DEVELOPMENT (if any)

None.

BACKGROUND OF THE INVENTION

1. Field of the Invention

The present invention relates generally to a celebration device and more specifically to an illuminated mobile celebration device consisting of an object being stationary and capable of descending down a straight article and including a transportable base apparatus securing the straight article in a vertical position. The transportable base apparatus allows the current invention to function on or with a users head, face, hand and finger.

2. Description of the Prior Art

There are other inventions designed as an illuminated celebration device, which incorporate a vertical article, a movable object and a securing apparatus. Typical of these is U.S. Pat. No. 6,260,989 issued to Joseph V. Ingraselino on Jul. 17, 2001 and U.S. Pat. Application No. 20050138851 filled on Dec. 30, 2003 by Joseph V. Ingraselino. U.S. Pat. No. 6,260,989 discloses an illuminated stationary celebratory device having a confetti blower housing with LED digital display and other visual and sound effects and mounted on top of a vertical standing pole having tracks thereon upon which a movable ball is slidably mounted. The ball also has digital displays and lamps thereon. The pole is mounted on a stationary base stand and designed for fixed placement. In operation, at a predetermined time, the ball begins its descent from atop the pole and as it descends pole lamps illuminate and the LED's show the appropriate time. When the ball reaches its destination at the bottom of pole, the LED's indicate the appropriate time and all celebratory features of the device activate.

There exists a need for a celebratory device that can be used with a person such as on a ring, glasses or hats. There is still room for improvement in the art.

SUMMARY OF THE INVENTION

A first object of the present invention is to provide a mobile celebration device that will overcome the shortcomings of the prior art devices.

A second object is to provide a mobile celebration device comprising of an object, a straight article and a transportable base apparatus.

A third object is to provide a mobile celebration device, in which the straight article is incorporated with the transportable base apparatus in a vertical position allowing the object to be movable to descend and to reset thereon.

A forth object is to provide a mobile celebration device, in which the transportable base apparatus can take the form of eyeglasses, a hat, a tiara, a handle or a finger ring.

A fifth object is to provide a mobile celebration device, in which the transportable base apparatus would be worn by a user in a conventional manner when in the form of eyeglasses, a hat, a tiara and a finger ring.

A sixth object is to provide a mobile celebration device, in which the transportable base apparatus would be held in a users hand when in the form of a handle.

A seventh object is to provide a mobile celebration device, in which the object contains an LED or a plurality of LEDs.

An eight object is to provide a mobile celebration device, comprising one or more decorative elements.

A ninth object is to provide a mobile celebration device, in which the decorative elements have one or more of the following sets: New York's Time Square image, the words "Happy New Year" or the numbers of the new year, for example "2013."

A tenth object is to provide a mobile celebration device, in which the object is movable and could descend down the straight article in a controlled manner along with resetting itself in the same fashion atop the straight article through an electronic means.

An eleventh object is to provide a mobile celebration device, in which the moveable object is moved by a motor, wherein the moveable object is attached to a lead screw and the lead screw is coupled to the motor by means of a flexible coupling.

A twelfth object is to provide a mobile celebration device, comprising three vertical rods that are arranged to pass through the moveable object, where two of the three vertical rods provide power to the LED or plurality of LEDs contained in the moveable object and the third rod provides for a switch contact that limits the upward motion by the moveable object.

A thirteenth object is to provide a mobile celebration device, comprising two switch contacts and an integral circuit, which is provided for limiting the downward motion of the moveable object by opening one set of contacts and closing a set of contacts to power a stationary light display when the moveable object is at the bottom of its travel.

A fourteenth object is to provide a mobile celebration device, in which the electronic circuit consists of an astable timer which energizes a relay coil through a transistor with a timer cycle set to move the moveable object up and down the length of the straight article.

A fifteenth object is to provide a mobile celebration device, comprising a second astable timer connected to a transistor that regulates the descend motion of the moveable object.

A sixteenth object is to provide a mobile celebration device, comprising switch contacts at the top and bottom of the straight article that create a pause by cutting the motor circuit when the moveable object presses on them.

A seventeenth object is to provide a mobile celebration device, comprising a straight article in a vertical position where the straight article has a movable object that moves along the straight article, wherein the moveable object is moved through a mechanical means, wherein the straight article is a twisted wire pair that forms a helix where the moveable object descends the straight article in a controlled manner by engaging the helix by means of a gravity actuated clutch/release mechanism located inside the moveable object.

An eighteenth object is to provide a mobile celebration device, wherein the clutch mechanism consists of an inverted U channel to which two hinged clutch arms are attached, where the hinged clutch arms have a u-shaped notch in their ends to engage said helix.

A nineteenth object is to provide a mobile celebration device, comprising a gravity actuated open switch that turns the LEDs on attached to the movable object.

A twentieth object is to provide a mobile celebration device, wherein at the top of the straight article is a latch/ release mechanism to hold the moveable object at the top of straight article until an instruction is received to release the moveable object.

A twenty first object is to provide a mobile celebration device, wherein the moveable object is released by depressing a release button.

A twenty second object is to provide a mobile celebration device, wherein the release is controlled by a countdown timer.

A twenty third object is to provide a mobile celebration device comprising, a transportable base apparatus wherein the transportable base apparatus has a straight article mounted there on in a vertical position. The straight article being designed into the shape of one of a set of three dimensional stationary spheres, two dimensional stationary spheres or one dimensional stationary spheres to simulate an object dropping or descending from the top to the bottom of the straight article. Each of the stationary spheres containing numerous lighting elements programmed to light up in a sequence simulating a movable object dropping from top to bottom of the straight article.

A twenty forth object is to provide a mobile celebration device comprising, a transportable base apparatus, wherein the transportable base apparatus has a straight article mounted there on in a vertical position wherein the straight article is constructed as a electroluminescent panel or panels, that simulate a movable object.

A twenty fifth object is to provide a mobile celebration device comprising, a transportable base apparatus, wherein the transportable base apparatus is in the shape of a clip.

Further objects of the invention will appear as the description proceeds.

The present is an illuminated mobile celebration device consisting of an object being secured and capable of descending down a straight article and including a transportable base apparatus securing the straight article in a vertical position. The transportable base apparatus allows the current invention to function on or with a users head, face, hand and finger.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the append claims.

BRIEF DESCRIPTION OF THE DRAWING FIGURES

Various other objects, features and attendant advantages of the present invention will become more fully appreciated as the same becomes better understood when considered in conjunction with the accompanying drawings, wherein.

Figure 6:
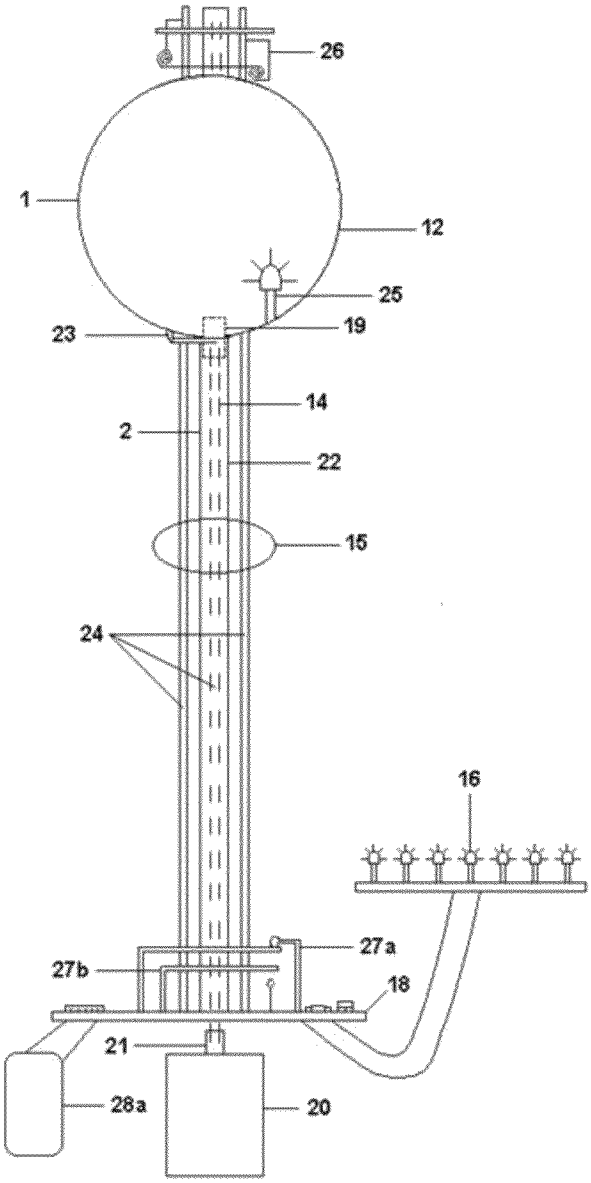
Figure 7:
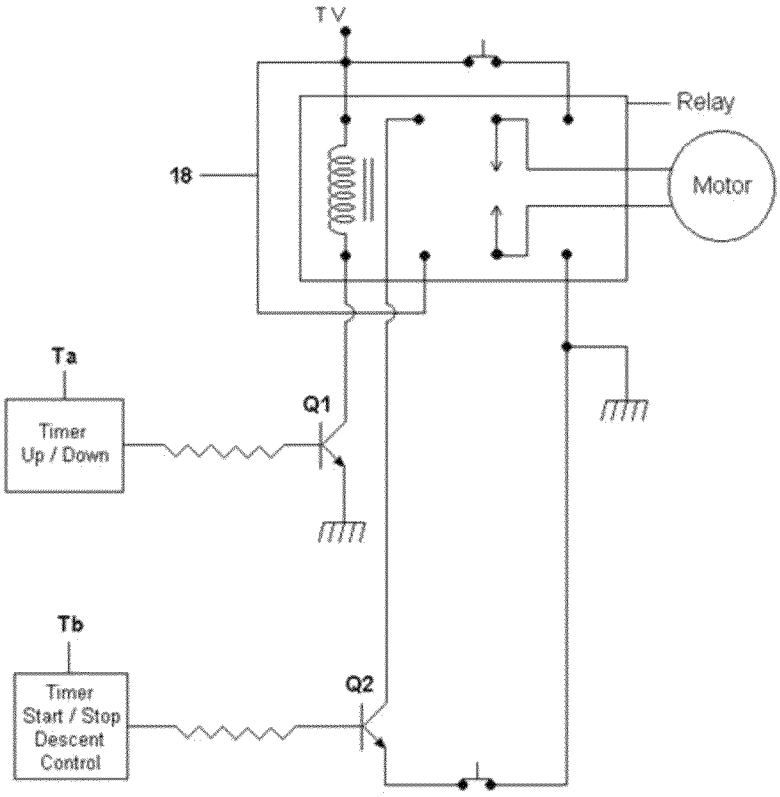
Figure 8:
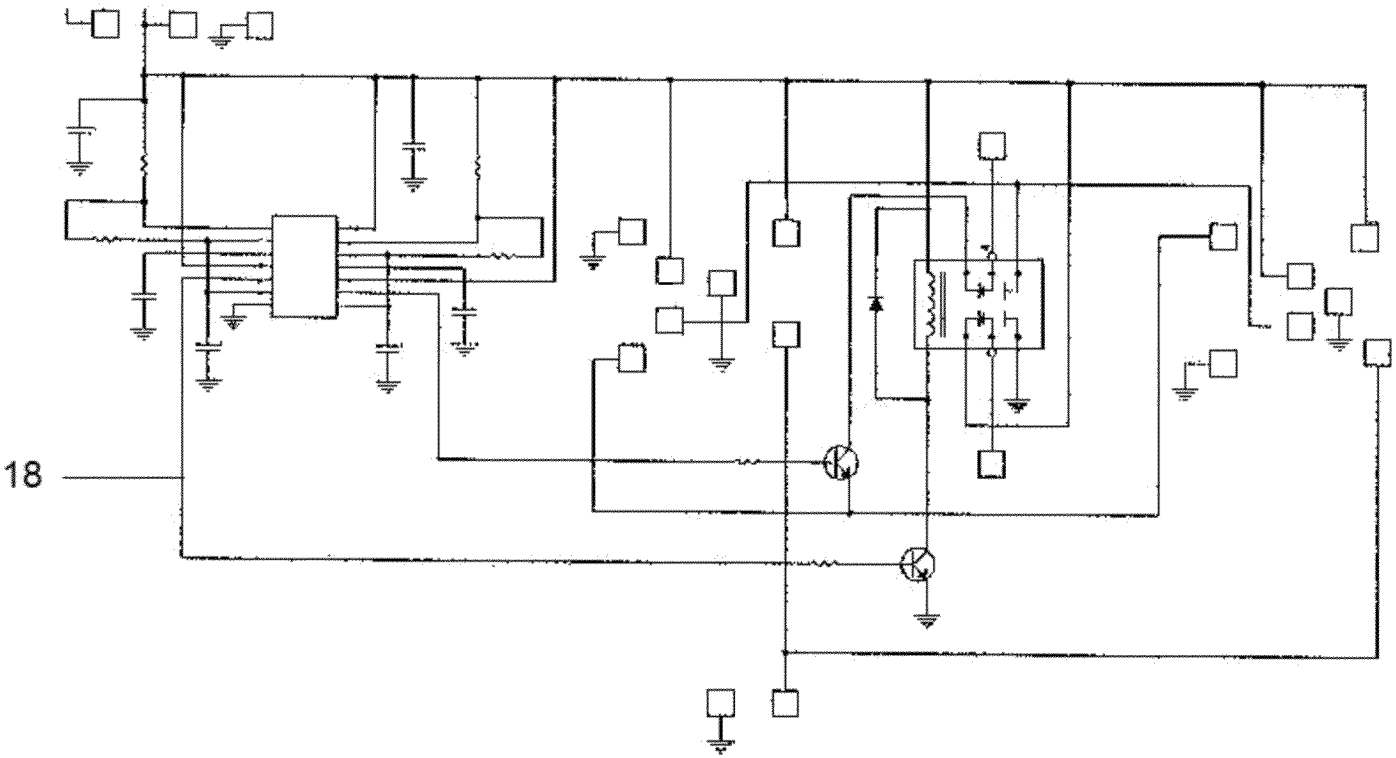
Figure 9:
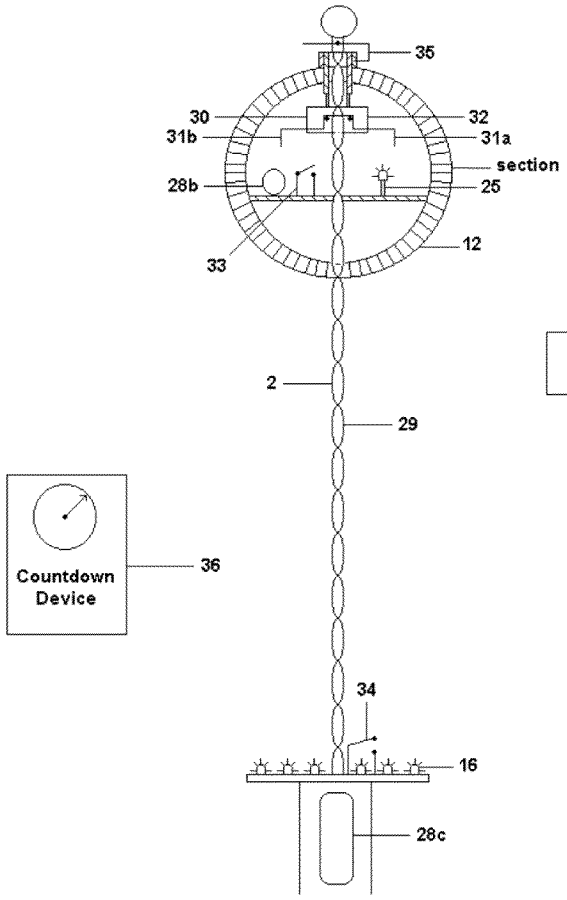
Figure 10:
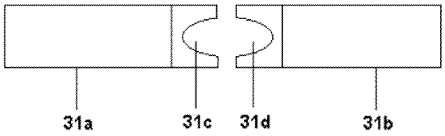
Figure 11:
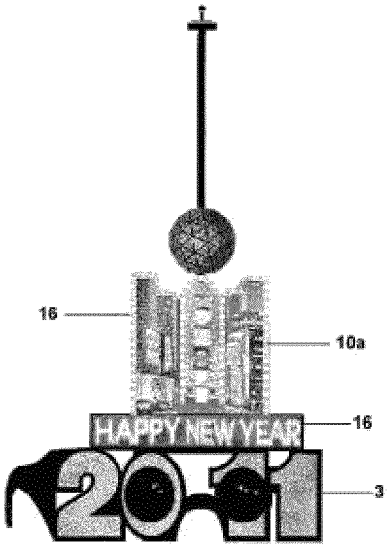
Figure 12:
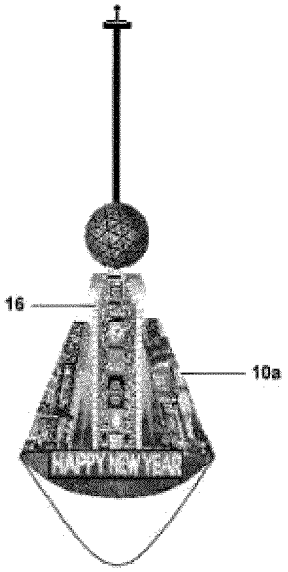
Figure 13:
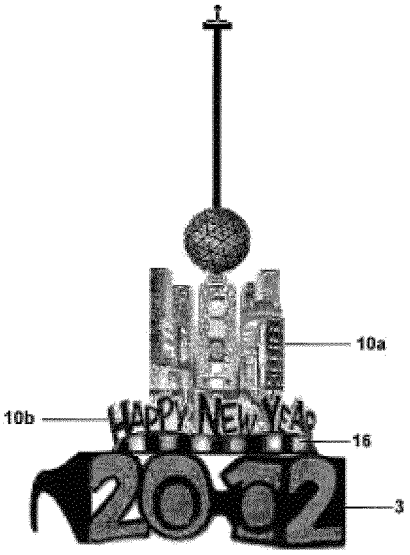
Figure 14:
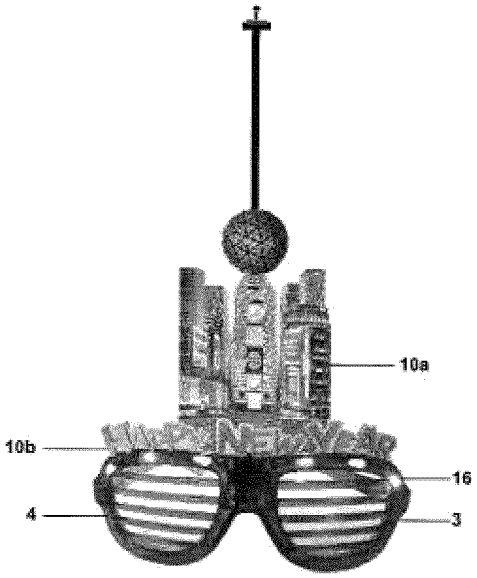
Figure 15:
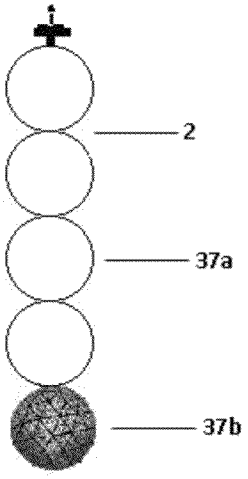
Figure 16:
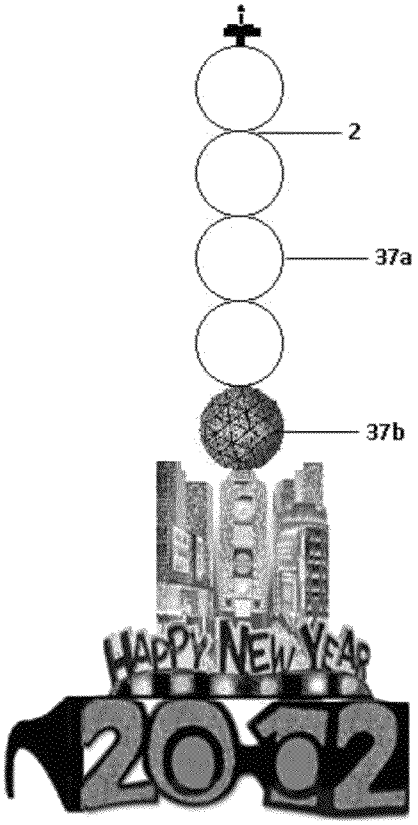
Figure 17:
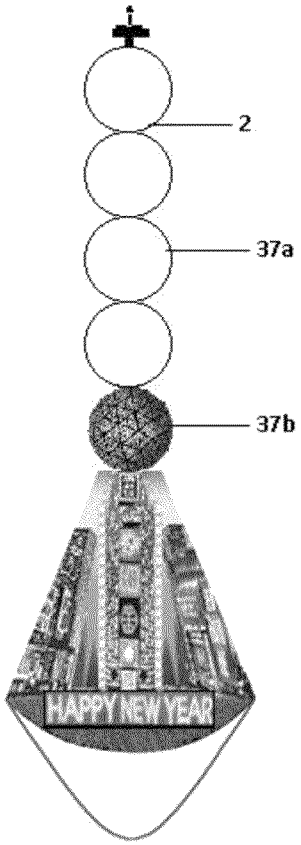
Figure 18:
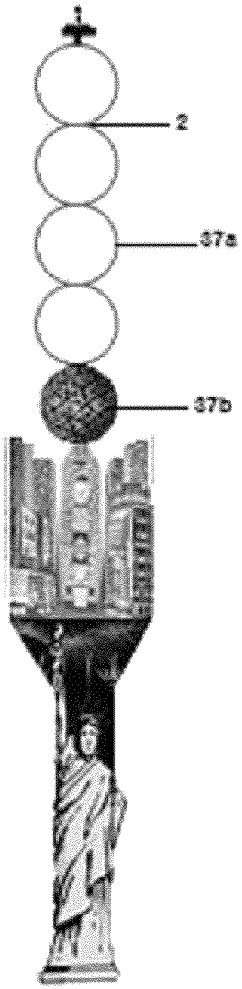
Figure 19:
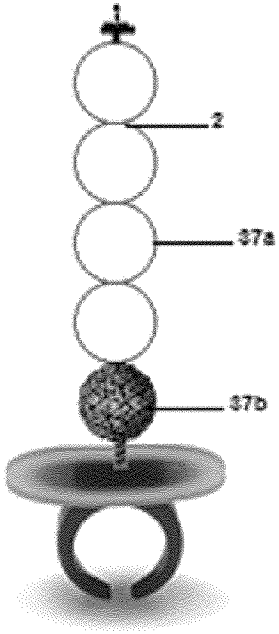
Figure 20:
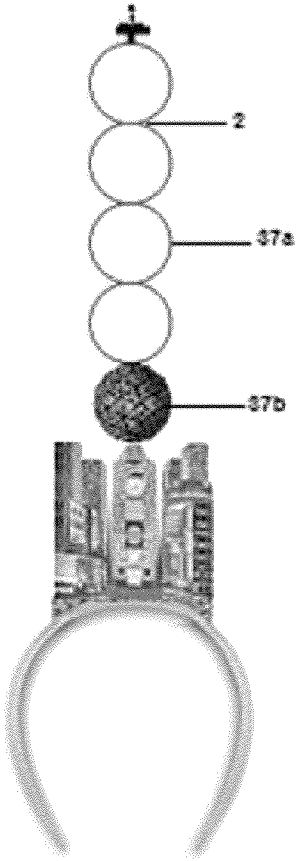
Figure 21:
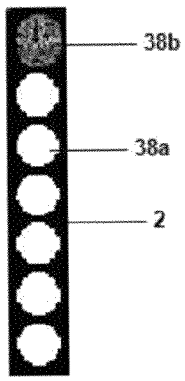
Figure 22:
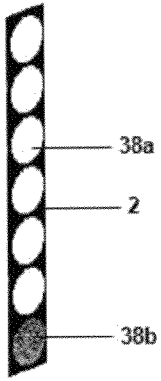
Figure 23:
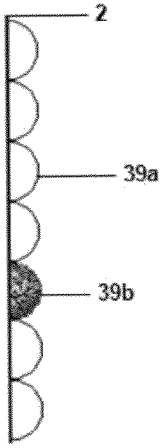
Figure 24:
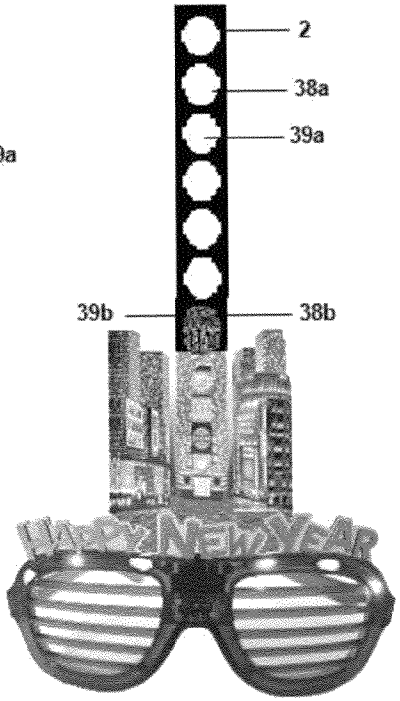
Figure 25:
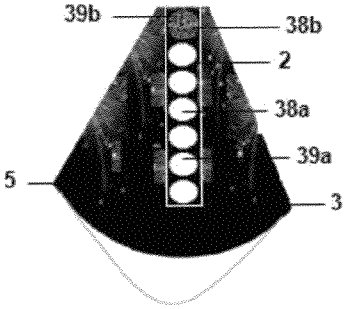
Figure 29:
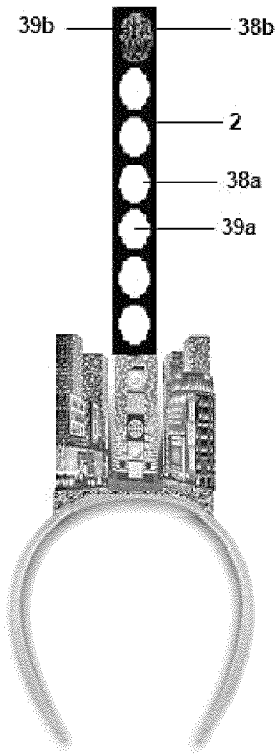
Figure 28:
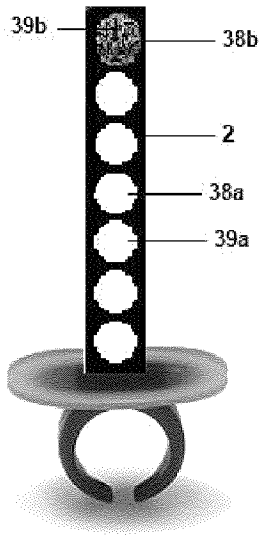
Figure 27:
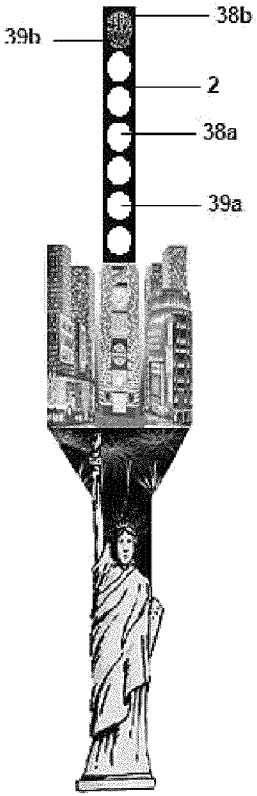
Figure 26:
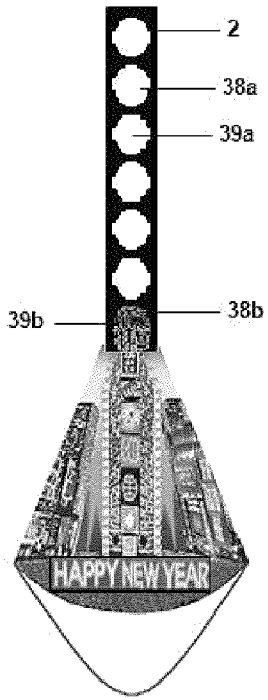
Figure 30:
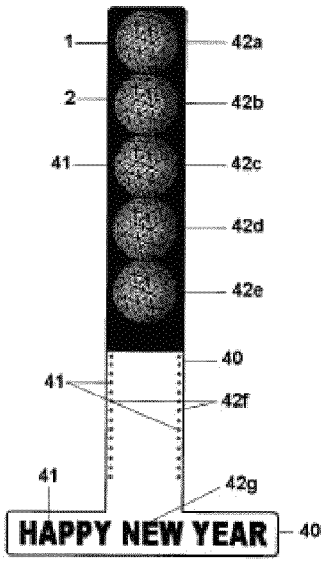
Figure 31:
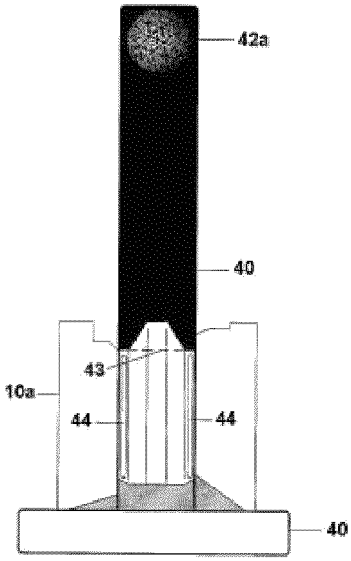
Figure 32:
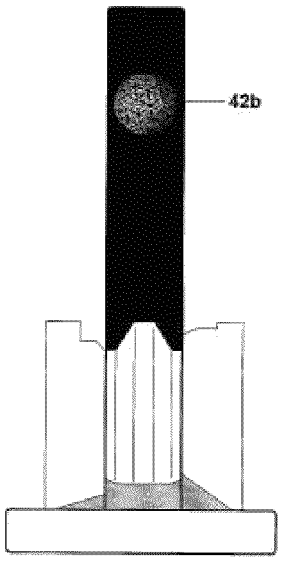
Figure 33:
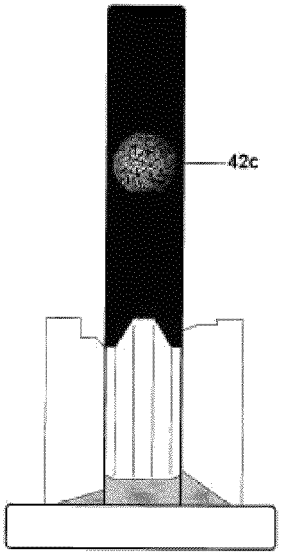
Figure 34:
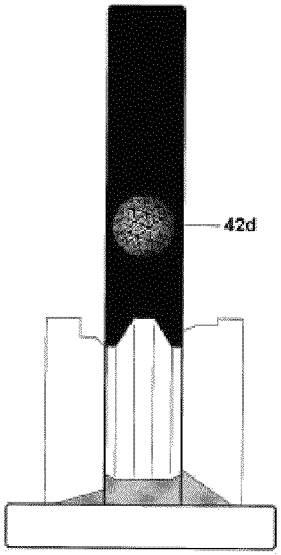
Figure 35:
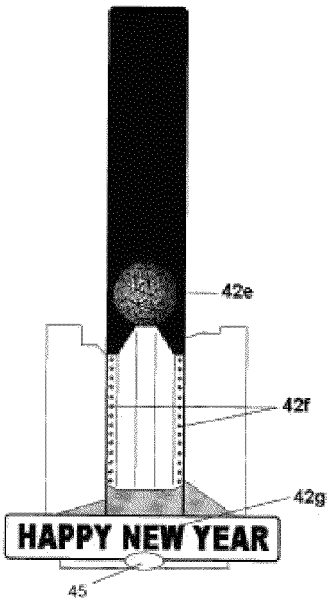

FIG. 6 displays a detailed account of the electronic embodiment of the present invention;

FIG. 7 displays a detailed account of the electronic schematic of the present invention;

FIG. 8 displays a detailed account of the electronic schematic of the present invention;

FIG. 9 displays a detailed view of the mechanical embodiment of the current invention;

FIG. 10 displays a side view of the mechanical embodiment of the current invention;

FIG. 11 shows an arrangement of a stationary light display along the perimeter and inner portion of the decorative element of the invention;

FIG. 12 shows the stationary light display just along the inner portion of the decorative element of another embodiment of the invention;

FIG. 13 displays another embodiment of the invention;

FIG. 14 displays a transportable base apparatus eyeglass;

FIG. 15 displays a side view of straight article with stationary spheres;

FIG. 16 displays a frontal view of straight article with stationary spheres;

FIG. 17 displays a frontal view of straight article with stationary spheres with another embodiment;

FIG. 18 displays a frontal view of straight article with stationary spheres with another embodiment;

FIG. 19 displays a frontal view of straight article with stationary spheres with another embodiment;

FIG. 20 displays a frontal view of straight article with stationary spheres with another embodiment;

FIG. 21 shows a front view of straight article having a one dimensional plane;

FIG. 22 shows a partial sided view of straight article having a one dimensional plane;

FIG. 23 shows a side view of straight article having a two dimensional plane;

FIG. 24 show a frontal view of straight article;

FIG. 25 further shows transportable bass apparatus hat incorporating straight article on its surface;

FIG. 26 shows a frontal view of straight article;

FIG. 27 shows a frontal view of straight article of another embodiment;

FIG. 28 shows a frontal view of straight article of another embodiment;

FIG. 29 shows a frontal view of straight article of another embodiment;

FIG. 30 shows a frontal view of straight article in the form of an electroluminescent panel;

FIG. 31 shows a decorative element incorporated with electroluminescent panel in the top position;

FIG. 32 shows a decorative element incorporated with electroluminescent panel in the next to top position;

FIG. 33 shows a decorative element incorporated with electroluminescent panel in the middle position;

FIG. 34 shows a decorative element incorporated with electroluminescent panel in the next to lowest position; and FIG. 35 shows a decorative element incorporated with electroluminescent panel in the lowest position.

DETAILED DESCRIPTION OF THE PREFERRED EMBODIMENTS

As outlined above the current invention is an illuminated mobile celebration device consisting of an object being secured and capable of descending down a straight article and including a transportable base apparatus securing the straight article in a vertical position. The transportable base apparatus allows the current invention to function on or with a users head, face, hand and finger.

FIGS. 1 through 5 display the main components of the invention in different embodiments. It shows a movable object 1 in a secured fashion, a straight article 2 and a transportable base apparatus 3. The straight article 2 is incorporated with transportable base apparatus 3 in a vertical position allowing movable object 1 to descend downward thereon. Transportable base apparatus 3 can take the form of eyeglasses 4, in this example shaped to look like the year numbers '2011', hat 5, tiara 6, handle 7 and finger ring 8.

Figure 2:
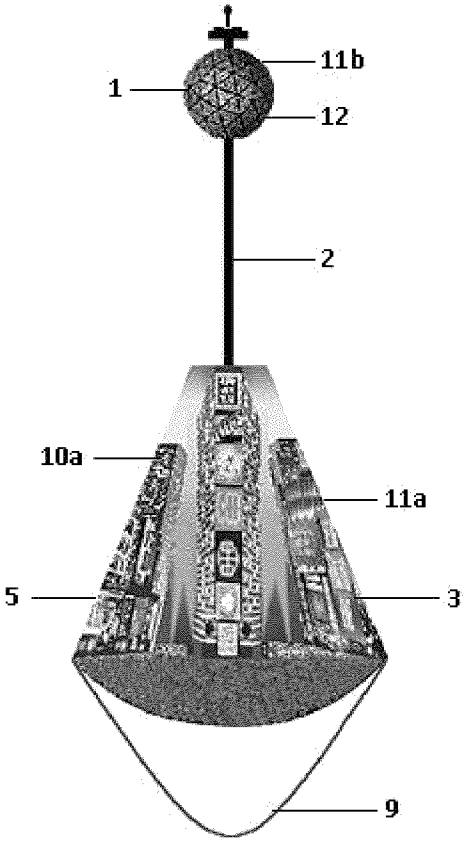
FIG. 2 is a front perspective view of a mobile celebration device according to the present invention.
Figure 1:
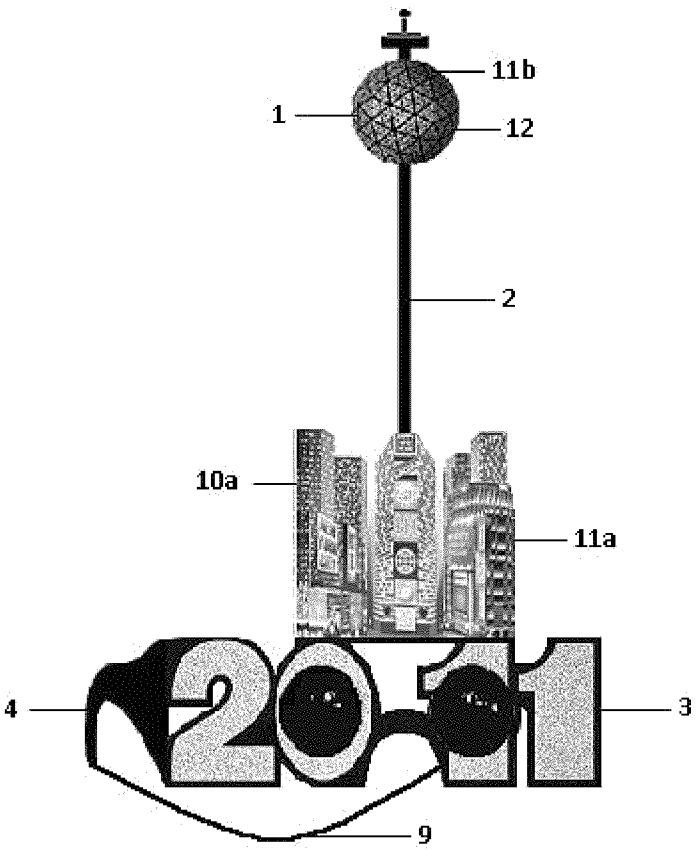
FIG. 1 is a front perspective view of a mobile celebration device according to the present invention.
Figure 5:
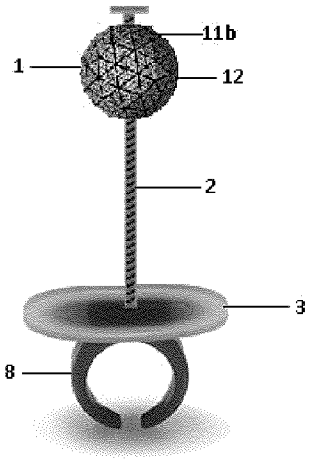
FIG. 5 is a front perspective view of a mobile celebration device according to the present invention.
Figure 4:
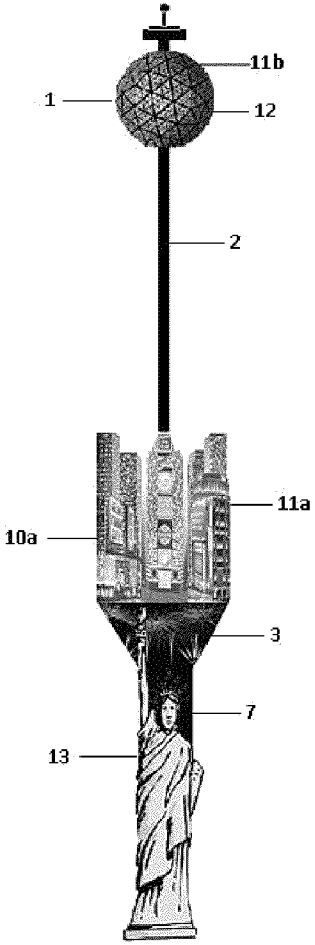
FIG. 4 is a front perspective view of a mobile celebration device according to the present invention.
Figure 3:
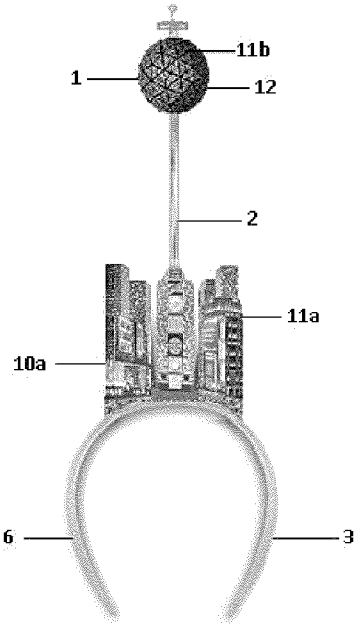
FIG. 3 is another front perspective view of a mobile celebration device according to the present invention.

Transportable base apparatus 3 would be worn by a user in a conventional manner when in the shape of one of a set of eyeglasses 4, hat 5, tiara 6, and finger ring 8. A Support portion 9, such as a strap, could be added to eyeglasses 4, hat 5 and tiara 6 of transportable base apparatus 3 for added stability. In the form of handle 7, as shown in FIG. 4, the transportable base apparatus 3 would be held in a user's hand.

The movable object 1 could descend down straight article 2 in a controlled manner along with repositioning itself in the same fashion atop article 2 with assistance from an electrical motor. Included with the electrical motor could be a portable power source, such as batteries, and other electrical features as further defined.

FIGS. 6, 7 & 8 illustrate a detailed account of the electronic embodiment of the current invention. The movable object 1 is moved up and down the straight article 2 by mechanical drive 15 with a stationary light display 16, all of which is controlled by electronic circuit 18.

In a preferred embodiment, the movable object 1 takes on the form of ball 12 having illuminating capabilities and is attached to nut 19 on lead screw 14, which is coupled to motor 20 by means of a flexible coupling 21 (ie. rubber tube). A lead screw 14 is inside a plastic tube 22, which has a slot cut along its length to accommodate a stake 23 that connects to the ball 12. When the stake 23 is in the slot of plastic tube 22 it prevents the nut 19 from rotating with lead screw 14 stabilizing ball 12. Three vertical rods 24 arranged in a triangular pattern around the lead screw 14 and tube 22 extends from electronic circuit board 18 and passes through the ball 12. Two of the three vertical rods 24 provide power to the LED 25 (light emitting diode) contained in the ball 12. The third rod provides for a switch contact 26 to the positive conducting rod that limits the upward motion by opening when ball 12 reaches the upper limit of travel.

In the preferred embodiment, there are two switch contacts integral to circuit board 18 at the base, provide for (1) limiting the downward motion of ball 12 by opening one set of contacts 27*a*, and (2) closing a set of contacts 27*b* to power stationary light display 16, when ball 12 is at the bottom of its travel.

The LED 25 contained in the ball 12 is a multicolor LED that contains internal circuitry to create a light display of multiple colors. The LED 25 is designed for a slow transition between colors appropriate for the desired effect.

As shown in FIGS. 6 & 7, electronic circuit 18 consists of an astable timer Ta which energizes a relay coil through a transistor Ql. The timer cycle is set to permit motion of ball 12 up and down the length of the drive assembly 15 with extra time for pause at the top and bottom of travel. The normally closed switch contacts 26 and 27*a* create the pause at the top and bottom positions by cutting the motor circuit when ball 12 presses on them. Timer Tb is an astable timer connected to transistor Q2 which provides for regulation of the decent motion of ball 12. The cycle time of timer Tb is chosen to start-stop the motion so that the travel time meets the period required for the controlled decent.

The on-off function of stationary light display 16 is controlled by switch contact 27*b* on circuit board 18. A desired number of LEDs can be added and positioned to stationary light display 16 for optimum light display.

A Battery pack 28*a*, in the preferred embodiment, provides power to circuit board 18, which distributes power to this version of the current invention. Until power source is disconnected, the entire sequence of operation continues indefinitely.

Alternatively, the movable object 1 could descend down the straight article 2 in a controlled manner by utilizing mechanical features along with gravity as its main source of power as further defined by the following features.

FIGS. 9 & 10 illustrate a detailed view of the mechanical embodiment of the current invention. The straight article 2 is made up of a twisted wire pair that forms helix 29 of a certain pitch. In an upright position, ball 12 descends straight article 2 in a controlled manner by engaging helix 29 by means of a gravity actuated clutch/release mechanism 30 located inside ball 12. When the entire assembly is turned upside down, clutch mechanism 30 releases from the helix 29 and the ball 12 is free to fall back to its starting position. Alternately, when the ball 12 is pushed up straight article 2, the two hinged clutch arms 31*a* and 31*b* skip over helix 29.

The clutch mechanism 30 consists of an inverted U channel 32 to which the two hinged clutch arms 31*a* and 31*b* are attached. The hinged clutch arms 31*a* and 31*b* feature a u-shaped notch 31*c* and 31*d* in their ends, intended to engage helix 29. Hinged clutch arms 31*a* and 31*b* are imbalanced to provide for their engagement of helix 29 when the assembly is upright. When the assembly is inverted, the hinged arms 31*a* and 31*b* swing away from helix 29.

LED assembly 25 is mounted inside ball 12, but in this arrangement, battery pack 28*b* and a gravity actuated normally open switch 33 turns the LED assembly 25 on when the assembly is upright. A stationary light display 16 is turned on when the weight of ball 12 closes a normally open momentary switch 34 which is located at the bottom of helix 29.

The top of the straight article 2 could also feature a latch/release mechanism 35 to hold ball 12 at the top of straight article 2 until an instruction is received to release ball 12. This end could be achieved manually by depressing the release at the desired time. The release could also be accomplished electrically or mechanically by coupling to a countdown timer 36 at a remote location employing common techniques. The power source (electrical or mechanical) would be integral to the countdown timer assembly.

An electrical power source, in this example a battery pack 28*c*, provides power for the countdown timer 36 and stationary light display 16.

As shown in FIGS. 1 through 5, the decorative element 10*a* could be attached or incorporated into the transportable base apparatus 3 and/or the straight article 2. The decorative element 10*a* could resemble in appearance a famous landmark, such as New York's Times Square 11*a*. object 1, ball 12, could resemble in appearance the Times Square New Year Ball 11*b*.

In the form of the handle 7, the transportable base apparatus 3 can take on the form to resemble in appearance a known structure or element such as the the Statue of Liberty 13 as shown in FIG. 4.

The Stationary light display 16 can be arranged in many forms with transportable base apparatus 3 of the Mobile Celebration Device. FIG. 11 shows an arrangement of the stationary light display 16 along the perimeter and inner portion of the decorative element 10*a*. Stationary light display 16 could further include being in the shape of letters to form words, in this example the words 'Happy New Year' as shown in FIGS. 11 and 12. FIG. 12 further shows the stationary light display 16 just along the inner portion of the decorative element 10*a*.

The decorative element 10*a* could be combined with the decorative element 10*b* as shown in FIGS. 13 and 14. In this arrangement, which could be one of many, decorative element 10*b* could take on the shape of the words 'Happy New Year.' In another arrangement decorative element 10*b* could take on the form of the numbers of the new year, for example '2011' Part or all of stationary light display 16 could be arranged to light up around decorative element 10*b* as further shown in FIGS. 13 and 14.

In FIG. 14, the transportable base apparatus 3 eyeglasses 4 take on the outer shape of a standard pair of eyeglasses.

A further alternative design of the current invention is shown in FIG. 15. In this design, the straight article 2 would be designed into several stationary 3 dimensional spheres 37*a* to resemble and simulate the function of the ball 12 as previously outlined. To achieve this end, each stationary sphere 37*a* would contain numerous lighting elements programmed to light up in a sequence simulating ball 12 and its objective to drop from the top toward the bottom of straight article 2.

FIG. 15 is a side view of the straight article 2 stationary spheres 37*a*, while FIGS. 16 through 20 shows a frontal view of straight article 2 stationary spheres 37*a* incorporated with the current invention with different embodiments of the decorative element. The lighted stationary sphere 37*b* represents the completion of the desired sequence.

Another alternative design is shown in FIGS. 21 and 23. In this embodiment, the straight article 2 would be designed having a one dimensional plane as shown in FIG. 21 or a two dimensional plane as shown in FIG. 23. Several stationary one dimensional circle shapes 38*a* or several stationary two dimensional circle shapes 39*a* could also resemble and simulate the function of ball 12 as previously outlined. Each circle shape 38*a* or 39*a* would contain numerous lighting elements programmed to light up in a sequence resembling ball 12 and its objective to drop from the top toward the bottom of straight article 2.

FIG. 21 shows a front view of the straight article 2 having a one dimensional plane including several stationary one dimensional circle shapes 38*a* with lighted one dimensional stationary circle shape 38*b* representing the beginning of the desired sequence. FIG. 22 shows a partial sided view of the straight article 2 having a one dimensional plane with lighted one dimensional stationary circle shape 38*b* representing the completion of the desired sequence.

FIG. 23 shows a side view of the straight article 2 having a two dimensional plane as defined by several two dimensional circle shapes 39*a* with lighted two dimensional stationary circle shape 39*b* representing the objective of the desired sequence.

FIGS. 24 through 29 show a frontal view of the straight article 2 representing either the above defined one or two dimensional plane having several one dimensional stationary circle shapes 38*a* or several two dimensional circle shapes 39*a* incorporated with the current invention. Lighted one dimensional stationary circle shape 38*b* and lighted two dimensional stationary circle shape 39*b* represents the completion or beginning of the desired sequence.

FIG. 25 further shows the transportable bass apparatus 3 as a hat 5, incorporating straight article 2 on its surface. Conforming with this representation of the current invention, the straight article 2 represents either the above defined one or two dimensional plane having several one dimensional stationary circle shapes 38*a* or several two dimensional circle shapes 39*a* incorporated with the current invention. Lighted one dimensional stationary circle shape 38*b* and lighted two dimensional stationary circle shape 39*b* represents the completion or beginning of the desired sequence.

A mobile device such as an ipad, iphone or kendel fire, could incorporate a program or App which allows a user to display on said device, a video or animation of a movable object such as a lighted ball which resembles the Times Square New Years Ball, descending down a straight article such as a pole and finishing with a lighted display as fully outlined in this disclosure.

All of the transportable base apparatuses disclosed in this disclosure including eyeglasses, hat, tiara, handle finger ring or clip, could be modified to except or hold the mobile device to achieve the desired results as outlined throughout.

FIG. 30 further shows a frontal view of straight article 2 in the form of an electroluminescent panel 40. An Electroluminescent panel 40 is a flat light bulb sandwich consisting of layers of conductive and non-conductive plastic and a layer of phosphor. The phosphor is laminated between two conductive layers and, as a voltage is applied between the two conductive layers, or electrodes, the phosphor emits light energy. When a high-quality, high-resolution image is printed over the light, it behaves like a backlit sign.

By dividing the printed image into several different sections, the sections can be illuminated separately from one another. Each section can be programmed and sequenced to provide an animated effect as the phosphor light is flashed and/or faded in each of the sections in and out to create the impression of movement within the static printed image.

In FIG. 30 article 2, the electroluminescent panel 40 is incorporated with image 41 having a simulated movable object 1, defined several times. When sections 42*a* through 42*g* are illuminated separately, the impression of movement by movable object 1 will simulate the function of a ball 12 to create the desired result as if a ball was dropping from the top to the bottom of article 2. All previously stated lighted functions would be simulated when movable object 1 reached the bottom of article 2, by illuminating sections 42*f* and 42*g* as desired. Electroluminescent panels can also be used to create different backgrounds, shapes or artwork.

As shown in FIG. 31 a decorative element 10*a* is incorporated with electroluminescent panel 40. In this example the decorative element 10*a* could be made like a sleeve having an opening across its entire bottom and an opening 43 at its top center. The vertical portion of the electroluminescent panel 40 could go through the opening on the bottom and through opening 43 while the horizontal portion of the electroluminescent panel 40 would be positioned beneath element 10*a*. This sleeve feature designed for the decorative element 10*a* could also conceal the battery pack and related components associated with the electroluminescent panel 40. Openings 44 could be incorporated into decorative element 10*a* so illuminating section 42*f* could be achieved properly.

To further denote the desired sequence, as defined prior to the last paragraph, section 42*a* would be programmed to illuminate first as also shown in FIG. 31. FIG. 32 shows section 42*b* illuminated while FIGS. 33 and 34 continue to show the progression of descent with section 42*c* illuminated then section 42*d* being illuminated. FIG. 35 shows the object at the bottom of article 2 of the vertical portion of electroluminescent panel 40 as denoted with section 42*e* being illuminated. Following the illumination of section 42*e*, sections 42*f* and 42*g* are then illuminated along with section 42*e*. After a predetermined time of illumination from sections 42*e*, 42*f* and 42*g*, the sequence would begin all over again starting with section 42*a* being illuminated.

Further shown in FIG. 35 is a clip 45, which could be incorporated with electroluminescent panel 40, or straight article 2, or decorative element 10*a* or decorative element 10*b* or stationary light display 16 depending on what version of the current invention is produced, allowing transportable base apparatus 3 to be manufactured separately. Electroluminescent panel 40 and all of the disclosed features, could easily and affordably be incorporated with every transportable base apparatuses disclosed throughout this application to achieved the desired result of the current invention.

What has been described is just one of many ways that a electroluminescent panel could be incorporated with the current invention. This current invention does not intent to be limited by one electroluminescent panel having a vertical and horizontal portion. The current invention may be achieved by utilizing several electroluminescent panels of various design and shape.

In another embodiment, the straight article 2 could be directly attached to the clip 45. The clip 45 can then be used to connect the straight article 2 to any article or platform or to different transportable base apparatuses or the clip 45 itself could be a transportable base apparatus. A standard type clip or clipping device can be used.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

While certain novel features of this invention have been shown and described are pointed out in the annexed claims, it is not intended to be limited to the details above, since it will be understood various omissions, modifications, substitutions and changes in the forms and details of the device illustrated and in its operation can be made by those skilled in the art without departing in any way from the spirit of the present invention.

That which is claimed is:

1. A mobile celebration device comprising; a moveable object moved by a motor, wherein said moveable object is attached to a lead screw and said lead screw is coupled to said motor by means of a coupling, wherein three vertical rods are arranged to pass through said moveable object, where two of the three said vertical rods provide power to LEDs contained in said moveable object and the third said rod provides for a switch contact that limits the upward motion by said moveable object, wherein an electronic circuit consists of an astable timer which energizes a relay coil through a transistor with a timer cycle set to move said moveable object up and down, wherein a second astable timer connected to a transistor regulates the descend motion of said moveable object.

2. A mobile celebration device as claimed in claim 1, further comprising two switch contacts and an integral circuit, said contacts provided for limiting the downward motion of said moveable object by opening one set of said contacts and closing a set of said contacts to power a stationary light display when said moveable object is at the bottom of its travel.

3. A mobile celebration device as claimed in claim 1, further comprising switch contacts at the top and bottom of said straight article that create a pause by cutting said motor circuit when said moveable object presses on them.

4. A mobile celebration device comprising; a straight article in a vertical position where said straight article has a movable object that moves along the straight article, wherein said moveable object is moved through a mechanical means, wherein said straight article is a twisted wire pair that forms a helix where said moveable object descends said straight article in a controlled manner by engaging said helix by means of a gravity actuated clutch/release mechanism located inside said moveable object.

5. A mobile celebration device as claimed in claim 4, where said clutch mechanism consists of an inverted U channel to which the two said hinged clutch arms are attached, where said hinged clutch arms have a u-shaped notch in their ends to engage said helix.

6. A mobile celebration device as claimed in claim 4, where an LED or a plurality of LEDs are attached to said moveable object.

7. A mobile celebration device as claimed in claim 6, where a gravity actuated open switch turns said LEDs on.

8. A mobile celebration device as claimed in claim 4, where at the top of said straight article is a latch/release mechanism to hold said moveable object at the top of straight article until an instruction is received to release said moveable object.

9. A mobile celebration device as claimed in claim 8, where the moveable object is released by depressing a release button.

10. A mobile celebration device as claimed in claim 8, where said release is controlled by a countdown timer.

11. A mobile celebration device as claimed in claim 4, further comprising a transportable base apparatus, where said transportable base apparatus is in the shape of one of a set of eyeglasses, hat, tiara, handle, finger ring or clip.

12. A mobile celebration device comprising; a movable object moved by a motor, wherein said movable object is attached to a lead screw and said lead screw is coupled to said motor by means of a coupling, where a vertical rod is arranged to pass through said movable object wherein said rod provides for a switch contact, the switch contact limits the upward motion by said movable object, where an electronic circuit consisting of an astable timer energizes a relay coil through a transistor with a timer cycle set to move said moveable object up and down and a second astable timer connected to a transistor which regulates the descend motion of said movable object.

13. A mobile celebration device comprising; a movable object moved by a motor, wherein said movable object is attached to a lead screw and said lead screw is coupled to said motor by means of a coupling, further comprising two switch contacts and an integral circuit, wherein said contacts provide for limiting the downward motion of said moveable object by opening one set of said contacts and closing a set of said contacts to power a stationary light display when said moveable object is at the bottom of its travel, and where the switch contacts at the top and bottom of said straight article create a pause by cutting said motor circuit when said moveable object presses on them.

* * * * *